United States Patent [19]

Enomoto et al.

[11] 4,450,886

[45] May 29, 1984

[54] METHOD OF PRODUCING SUCTION MANIFOLDS FOR AUTOMOBILE ENGINES

[75] Inventors: Michitoshi Enomoto; Yasuo Shimizu, both of Osaka, Japan

[73] Assignee: Nakamura Kinzoku Kogyosho, Inc., Osaka, Japan

[21] Appl. No.: 449,120

[22] Filed: Dec. 13, 1982

Related U.S. Application Data

[63] Continuation of Ser. No. 168,603, Jul. 14, 1980, abandoned.

[51] Int. Cl.[3] ..... B22D 19/00

[52] U.S. Cl. ..... 164/75; 164/100

[58] Field of Search ..... 164/75, 97, 100, 101, 164/102, 98

[56] References Cited

U.S. PATENT DOCUMENTS 1,025,817 5/1912 Luckenbach ..... 164/100

3,423,279 1/1969 Grover ..... 164/75 X

*Primary Examiner*—Gus T. Hampilos

*Attorney, Agent, or Firm*—Gabriel P. Katona

[57] ABSTRACT

A method of producing suction manifolds for automobile engines. In forming an exhaust gas re-circulating pipe passage integrally with a suction manifold for re-circulating exhaust gases from the engine to the suction manifold, a curved pipe of aluminum having a high-temperature resistant film formed on its surface is molded into a manifold of aluminum alloy at a suitable place on the latter.

6 Claims, 4 Drawing Figures

METHOD OF PRODUCING SUCTION MANIFOLDS FOR AUTOMOBILE ENGINES

This is a continuation of Ser. No. 168,603, filed on July 14, 1980, now abandoned.

BACKGROUND OF THE INVENTION

The present invention relates to a method of producing suction manifolds for automobile engines, and particularly it relates to a method of producing suction manifolds for automobile engines to meet recent exhaust gas control regulations.

Recently, the automobile industry has been making every effort to meet exhaust gas control regulations and particularly it has been making improvements in the field of engines. For example, as shown in FIG. 1, these improvements include the thermal reactor system wherein secondary air is introduced into exhaust gases containing carbon monoxide and hydrocarbons which have failed to burn in a cylinder a, for re-combustion of said unburnt combustibles in a thermal reactor b, and an exhaust gas re-circulating system wherein a portion of the exhaust gases from the cylinder a is fed into a suction manifold d via a circulation pipe c and then into the cylinder a to lower the combustion temperature to suppress the formation of nitrogen oxides. The exhaust gas re-circulating system necessitates affixing an exhaust gas circulating pipe to the suction manifold formed of an aluminum alloy casting, and attempts have been made to provide a compact form wherein said circulating pipe is integrated with and contained in the manifold.

Methods of installing such circulation pipe integrally with the manifold include one in which a thicker wall portion of the manifold is drilled, but it is impossible or very difficult to work said pipe to provide a carved pipe. Alternatively, subsequent to casting using a curved bar-like cell core, the latter is withdrawn to form a pipe passage. In this case, however, there are drawbacks, including one that if the angle of the bend is large, the withdrawal of the core is difficult. Thus, these methods are lacking in practicability and mass-production capability.

SUMMARY OF THE INVENTION

Accordingly, a first object of the invention is to provide a method of producing suction manifolds, wherein in casting a suction manifold in the form of an aluminum alloy casting, a curved aluminum pipe is cast into said manifold so as to be integral therewith without being melt-damaged, to form an exhaust gas re-circulating pipe passage.

Further, in affixing an exhaust gas re-circulating pipe to a manifold as a means for prevention of environmental pollution, if such affixing results in the shape and thickness of the resulting manifold varying considerably from those of a conventional suction manifold, this would be inconvenient. In the conventional method described above in which the manifold body is drilled to form an exhaust gas re-circulating pipe passage, the wall thickness of said body must of necessity be increased. Accordingly, a second object of the invention is to provide a method of producing suction manifolds for automobile engines, wherein an exhaust gas re-circulating pipe passage is formed without increasing the wall thickness of the manifold body.

A third object of the invention is to form an exhaust gas re-circulating pipe passage in a manifold body with any desired angles of bends.

A fourth object of the invention is to provide a method whereby suction manifolds having an exhaust gas re-circulating pipe passage can be mass-produced.

DESCRIPTION OF THE PREFERRED EMBODIMENTS

Figure 1:
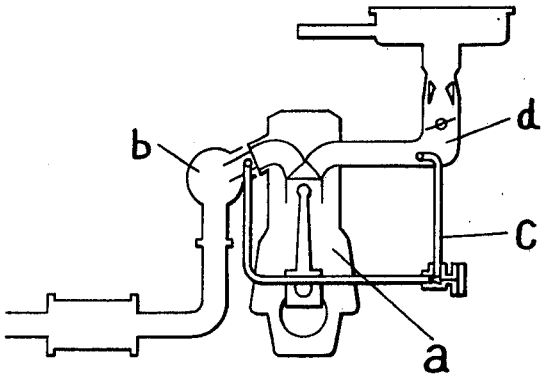
FIG. 1 is a schematic view of an automobile engine to which the present invention has been applied.
Figure 2:
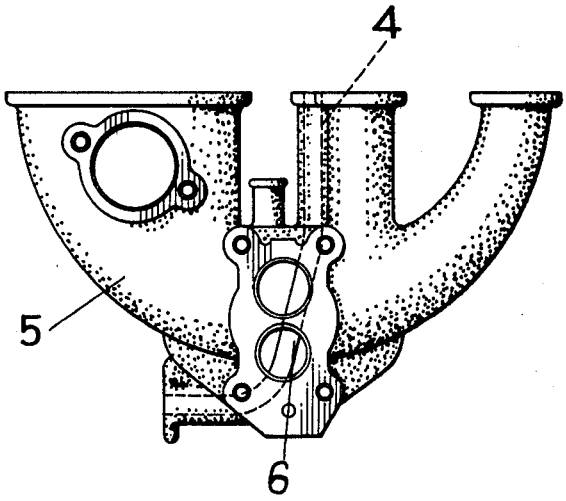
FIG. 2 is a front view of suction manifold obtained according to the invention.
Figure 3:
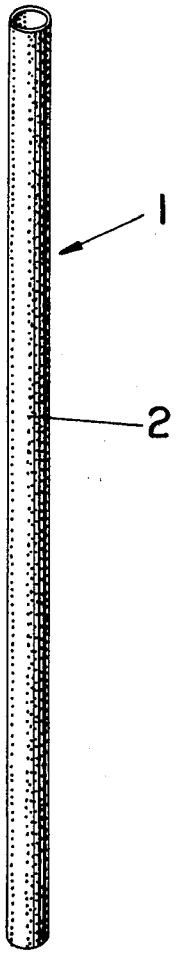
FIG. 3 is a perspective view of a straight aluminum pipe according to an embodiment of the invention.

First of all, the surface of a straight aluminum pipe 1 is washed with trichlene, acid or alkali solutions for degreasing purposes, then is treated with a solution of a salt, whereby a film 2 is formed on said straight aluminum pipe 1 (FIG. 3). Said solution of a salt comprises one element selected out of the following substances; phosphate such as sodium dihydrogen phosphate, phosphate of zinc or aluminum phosphate, haloid salt such as zinc fluoride, sodium fluoride, sodium silicofluoride or acid ammonium fluoride; chromate such as chromic acid, potassium bichromate or sodium chromate; or, sodium hydroxide. To said solution of a salt, acid such as fluoric acid or phosphoric acid is added for accelerating the reaction of the element and controlling the pH. After a film 2 has been formed with said solution of a salt, a drying and heating step may follow as needed.

Figure 4:
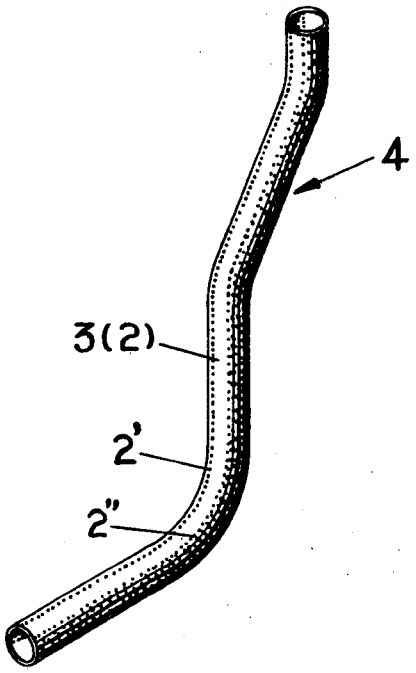
FIG. 4 is a perspective view of a curved aluminum pipe according to another embodiment of the invention.

After the formation of the film 2 on the straight aluminum pipe 1, a lubricating film 3 is formed on said film 2, whereupon the pipe 1 is subjected to bending work to provide a curved aluminum pipe 4, as shown in FIG. 4. The curved aluminum pipe 4 is then placed at a suitable position in a manifold body 5 of aluminum alloy casting and integrally cast to provide a suction manifold having an exhaust gas re-circulating pipe passage 6 formed therein.

The lubricating film 3 is formed of a member or a mixture of members selected from the organic lubricant group consisting of fatty acids and salts thereof, esters such as oils and fats, and condensation polymerization compounds, or an inorganic lubricant group consisting of graphite, carbon black, molybdenum bisulfide, and boron nitride.

More in detail, said film formed on the surface of the pipe is immersed in either of the liquefied lubricant wherein an organic lubricant such as fatty acid, for example, stearic acid, sodium stearate, or zinc stearate etc., or salts thereof is resolved in a volatile organic solvent with low viscosity such as alcohol or carbon tetrachloride at the rate of 0.5–5% by weight; or a dispersive lubricant wherein an inorganic lubricant such as graphite, molybdenum disulfide or boron nitride whose particles having a size less than $3\mu$, is dispersed in the water or a volatile organic solvent with low viscosity such as alcohol, or ketone etc. at the rate of 5–35% by weight; to form a lubricating film thereon, whose particles have a size less than $10\mu$, the minimum but necessary thickness. Instead, the lubricating film may be formed by spraying or spreading them with a brush on the film. After the lubricating film has been formed, it is dried, and the volatile matter thereof is heated, as needed, to be resolved after the bending work.

In the above, a straight aluminum pipe 1 has been used. However, if a curved aluminum pipe, which has been so worked in advance, is used, it will be cast together with a manifold body 5 simply after said film 2 is formed on the surface of said curved aluminum pipe. However, a lubricating film 3 may be formed thereon without any trouble.

The curved aluminum pipe 4 thus treated has a melting resistance given by said films 2 and 3 and will not be subjected directly to hot temperatures during pouring of metal. Thus, even under severe pouring conditions, it will retain its hollow configuration without being melt-damaged when it is cast into the manifold body 1. This is apparent from the following table. The table shows the results of tests of the present and conventional methods, wherein the marks ○, Δ and X mean good, rather bad and bad, respectively. In said tests, the mold temperature was 350° C. and the pouring temperature was 780° C.

| Method of coating | Film characteristics | | | State of cast pipe |
|---|---|---|---|---|
| | Adhesion | Lubricity | Resistance to molten metal | |
| Untreated | — | X | X | Melt-damaged |
| Chemical treatment | ○ | Δ | ○ | Not melt |
| Chemical and lubricant treatments | ○ | ○ | ○ | " |

The following is what can be seen from this table.

The casting of a suction manifold, which is of very complicated configuration and which has a very thin wall, would be impossible if the mold temperature and pouring temperature are low since this would cause misrun. Therefore, even if the curved aluminum pipe to be cast inside is taken into account, the mold temperature and pouring temperature must be as high as or even higher than usual. With the usual molten metal temperature (730°–750° C.), therefore, a curved aluminum pipe (with a melting point of 660° C.) would naturally be melt-damaged to have its hollow filled with the molten metal, so that it is impossible to form the intended exhaust gas re-circulating pipe passage. According to the invention, however, as is apparent from the table, the presence of said chemical film assures that even if casting is carried out with a pouring temperature greater than usual, the curved aluminum pipe will be cast in with its configuration maintained without being melt-damaged.

The above table indicates that lubricity, which is somehwat poor if the chemical treatment alone is performed, can be greatly improved by forming a lubricating film on the chemical film. Higher lubricity means that these films have a higher resistance to seizure (and a higher resistance to molten metal obtained additionally in the case of an inorganic lubricating material) during bending operation on the straight aluminum pipe 1. In the present invention superior in lubricity, i.e., resistance to seizure, a chemical film 2 and a lubricating film 3 are formed on the straight aluminum pipe 1, as described above, and even if the latter is then subjected to bending work, these films 2 and 3 will not peel off, permitting the bending of the pipe. Thus, a pipe passage can be formed with any desired angles of bends. In addition, in cases where the lubricating film 3 is made of an inorganic lubricating material, as described above, a resistance to molten metal is added, making the invention more useful. Further, the chemicals used for forming the chemical film 2 serve to improve the adsorption of the lubricating film forming materials.

As for the high-temperature resistant film to be formed on the surface of the curved aluminum pipe 4, the chemical film 2 and/or lubricating film 3 is used as mentioned hereinbefore, but it is also possible to apply a heat-resisting film 2' which is coated with metal oxide such as alumina or silica, or metal oxide fine powder such as talc powder.

Examples according to the present invention will be given hereinafter.

EXAMPLE 1

A 1 mm thick aluminum pipe (with a melting point of 660° C.) ranging from 8–16 mm in outer diameter was immersed in a 10–20% (by weight) alkali solution of sodium hydroxide for degreasing, neutralized with a 5% (by volume) nitric acid solution (with a concentration of 60–62% and specific gravity of 1.38), washed with water, then immersed in a 3% (by weight) solution of zinc fluoride at a room temperature (about 25° C.) for 5–10 minutes, and following these steps was washed with water again and dried at 100°–120° C. for 10 minutes, which resulted in that the heat-resisting film which is adhesive, water-absorbent and porous was formed on the surface of the pipe.

Then said pipe having said film on the surface thereof was immersed in a 0.5–5% (by weight) carbon tetrachloride solution of stearic acid for 1 minute, dried at 100° C., which resulting in the formation of a homogeneous lubricating film on said film.

Following the steps mentioned above, the pipe was subjected to bending work by a bender, and a curved pipe of high accuracy was obtained without seizure. Such a curved aluminum pipe was disposed in a mold at 300° C. and molten aluminum alloy at 770°–780° C. was poured into the mold, whereby a manifold was obtained in such a manner that the aluminum pipe fully preserves its hollowness without causing melt-damage to the curved aluminum pipe.

EXAMPLE 2

After being subjected to the same pretreatments as those of Example 1, the aluminum pipe was immersed in a solution consisting of 3% (by weight) of zinc fluoride and 0.15% (by weight) of hydrogen fluoride (with a concentration of 45% and specific gravity of 0.99) at a room temperature (about 25° C.) for 3–5 minutes, washed with water, and dried at 100°–120° C. for 10 minutes, which resulting in the formation of the same heat-resisting film as that of Example 1 on the surface of the pipe.

Then said pipe was subjected to the same forming process of a lubricating film and casting process of the pipe as those of Example 1 to obtain a suction manifold as intended.

EXAMPLE 3

After being subjected to the same pretreatments as those of Example 1, the aluminum pipe was immersed in a 2% (by weight) solution of zinc silicofluoride at 95°–100° C. for 2–5 minutes, washed with water, and dried at 100°–120° C. for 10 minutes, which resulted in a formation of such a satisfactory film on the surface of the pipe as that of Example 1. The forming process of the lubricating film and casting process of the pipe, both of which followed said formation of the film, are the same as those of Example 1.

EXAMPLE 4

After being subjected to the same pretreatments as those of Example 1, the aluminum pipe was immersed in a 2.5% (by weight) solution of sodium silicofluoride at 95°-100° C. for 2-5 minutes, washed with water, and dried at 100°-120° C. for 10 minutes, which resulted in a formation of the same satisfactory film as that of Example 1. The forming process of the lubricating film and casting process of the pipe, which followed said formation of the film, are the same as those of Example 1.

EXAMPLE 5

After being subjected to the same pretreatments as those of Example 1, the aluminum pipe was immersed in a solution including a 2.5% (by weight) of sodium silicofluoride, 0.04-0.5% (by weight) of zinc fluoride and 0.005-0.03% (by weight) of acid ammonium fluoride at 95°-100° C. for 2 minutes, washed with water, and dried at 100°-120° C. for 10 minutes, which resulted in a formation of such a satisfactory film on the surface of the pipe as that of Example 1. The forming process of the lubricating film and casting process of the pipe, both of which followed said formation of the film, are the same as those of Example 1.

EXAMPLE 6

A 1 mm thick aluminum pipe (with a melting point of 660° C.) having an outer diameter of 12 mm, being degreased with a mixed acid solution including 10% (by volume) of nitric acid (with a concentration of 60-62% and specific gravity of 1.38) and 2% (by volume) of fluoric acid (with a concentration of 45% and specific gravity of 1.1), neutralized with 5% (by weight) of sodium hydroxide and washed with water, was immersed in a solution including 0.35% (by weight) of chromic acid anhydride, 0.14% (by volume) of fluoric acid (with a concentration of 45% and specific gravity of 1.1) and 0.5% (by volume) of phosphoric acid (with a concentration of 85% and specific gravity of 1.7) at a room temperature (about 25° C.) for 1-3 minutes, then washed with water again, dried at 100°-120° C. for 10 minutes, which resulted in a formation of an adhesive film on the surface of the pipe.

To said film formed on the surface of the pipe, a dispersive lubricant including ordinary quick-drying graphite or molybdenum disulfide was sprayed thinly with a spray, which resulted in a formation of a homogeneous lubricating film on said film.

Following these steps, the aluminum pipe having a film and lubricating film on the surface thereof are subjected to a casting process, same as that of Example 1, whereby a manifold was obtained in such a manner that the aluminum pipe preserves fully its hollowness without causing melt-damage to the aluminum pipe.

EXAMPLE 7

After being subjected to the same pretreatments as those of Example 6, an aluminum pipe was immersed in a solution including 1.5% (by weight) of potassium bichromate, 0.5% (by weight) of sodium fluoride and 2% (by volume) of phosphoric acid (with a concentration of 85% and specific gravity of 1.7) at 40° C. for 1-3 minutes, washed with water and dried at 100°-120° C. for 10 minutes, which resulted in a formation of an adhesive film. The forming process of the lubricating film and casting process of the pipe, both of which followed said formation of the film, are the same as those of Example 6.

EXAMPLE 8

After being subjected to the same pretreatments as those of Example 6, an aluminum pipe was immersed in a solution including 1.5% (by weight) of potassium bichromate, 0.5% (by weight) of sodium fluoride and 3% (by weight) of sodium dihydrogen phosphate at 40° C. for 1-3 minutes, and then subjected to the same process as those of Example 6, which resulted in a formation of a manifold as intended.

EXAMPLE 9

An aluminum pipe (with a melting point of 660° C.) was subjected to bending work into a fixed shape by a bender, and the obtained curved aluminum pipe was immersed in a 5% (by weight) solution of sodium hydroxide for 10 minutes, which, not being washed with water, was heated with a propane gas burner for 1 minute and a half, which resulted in a formation of a heat-resisting adhesive film on the surface of the curved aluminum pipe.

Following the steps mentioned above, said curved aluminum pipe was disposed in a mold at 350° C. and molten aluminum alloy at 780° C. was poured into the mold, whereby an inlet manifold was obtained in such a manner that the curved aluminum pipe fully preserves its hollowness without causing melt-damage to the curved aluminum pipe.

EXAMPLE 10

A 1 mm thick aluminum pipe (with a melting point of 660° C.) was subjected to bending work into a fixed shape by a bender. Then a coating material was prepared by mixing one or more than one kind of impalpable powder of metal oxide or similar fire-resisting substance, the size of such powder being less than 325 meshes, with water or a volatile dispersion medium with low viscosity such as alcohol, trichrol ethane or the like, the proportion of the former to the latter being 15-75% according to the size of the particle. Said bent pipe was coated in such a manner that a 5-100$\mu$ thick film was formed on the surface of the bent aluminum pipe by immersing said pipe in the coating material, spraying or spreading the coating material on the surface of the pipe. Following these steps, the pipe was dried so that the volatile matter of the coating material might escape in vapor and homogeneous high-temperature resistant film 2' was obtained. In this case the thickness of the film is controlled according to the properties of the heat-resisting impalpable powder and the dispersion concentration. A film of a thickness less than 5$\mu$ is insufficient with respect to the heat-resisting property which is the object of the invention. A film of a thickness more than 100$\mu$ is both unnecessary and uneconomical.

EXAMPLE 11

A 11 mm thick aluminum pipe (with a melting point of 660° C.) was subjected to bending work into a fixed shape by a bender. Then a coating material was prepared by mixing one or more than one kind of impalpable powder of easily oxidizable metal such as aluminum, copper, nickel or molybdenum, the size of such powder being less than 325 meshes, with water or a volatile dispersion medium with low viscosity such as alcohol, trichrol ethane or the like (a small quantity of a binder such as water glass, colloidal silica, resin or the like may be added, as needed). Said bent pipe was coated in such a manner that a 5–100μ thick film was formed on the surface of the bent aluminum pipe by immersing said pipe in the coating material, spraying or spreading the coating material on the surface of the pipe. Following these steps the the pipe was dried so that the volatile matter of the coating material might escape in vapor and a homogeneous high-temperature resistant film 2' was obtained. In this case a film of a thickness less than 5μ is insufficient with respect to the heat-resisting property which is the object of the invention. A film of a thickness more than 100μ is both unnecessary and uneconomical.

A curved aluminum pipe 4 having either a heat-resisting film 2' which is formed according to Example 10 or a heat-resisting film 2'' which is formed according to Example 11, and a curved aluminum pipe whose surface is left uncoated has been tested, the results being shown in the following table.

| | Pouring temp. (°C.) | Mold temp. (°C.) | Coating material | State of cast pipe |
|---|---|---|---|---|
| 1 | 770 | 200 | none | melt-damaged |
| 2 | " | 300 | " | " |
| 3 | " | 350 | " | " |
| 4 | " | 300 | Al fine powder | not melt |
| 5 | " | 350 | Al fine powder | " |
| 6 | 850 | 200 | talc fine powder | " |
| 7 | " | 300 | talc fine powder | " |
| 8 | " | 350 | talc fine powder | " |
| 9 | 900 | " | silica (hallow) | " |

According to the Examples, as is apparent from the above table, it is understood that even if casting is carried out under the usual mold temperature and pouring temperature conditions and even under severer conditions (mold temperatures of 300°–350° C. and pouring temperature of 850° C.), the curved aluminum pipe will not be melt-damaged and casting is performed without suffering any damage to its shape.

Further, the formation of high-temperature resistant film according to the Examples is very simple, only requiring the application and drying of a suspension of metal oxide fine powder or easily oxidizable metal fine powder.

As has been described so far, according to the invention, a curved aluminum pipe is integrally cast into a manifold to form an exhaust gas re-circulating pipe passage. Any pipe passage irrespective of its angles of bends can be formed as desired. Further, suction manifolds equipped with a re-circulating pipe passage which plays a very important role in meeting exhaust gas control regulations can be mass-produced with ease.

What is claimed is:

1. A method for producing suction manifolds for automobile engines comprising the steps of:

(a) applying to an outer surface of a curved aluminum pipe, a two layer film, by first applying directly on said surface of the pipe, as a first layer, a high-temperature resistant chemical film comprising materials selected from the group consisting of a phosphate, a halide, a chromate, an inorganic base, a metal oxide fine powder or an easily oxidizable metal fine powder, in the presence of a reaction accelerator selected from the group consisting of hydrofluoric acid or phosphoric acid, and then applying on the surface of the first layer, as a second layer, a lubricating film comprising materials selected from the group consisting of fatty acids and salts thereof, oils, fats, condensation polymerization compounds, graphite, carbon black, molybdenum bisulfide or boron nitride; and (b) placing said coated pipe onto a mold having a cavity shaped to define a manifold and then pouring molten aluminum into the mold to form a manifold wherein, after casting is completed, said curved aluminum pipe functions as an exhaust gas recirculating passage.

2. The method of claim 1 wherein the first film is formed on the surface of said pipe by applying to said surface a material selected from zinc fluoride, sodium silicofluoride, alumina or zirconia.

3. The method of claim 1 wherein the second film is formed on said first film by applying to the surface of the first film a material selected from graphite or molybdenum bisulfide.

4. The method of claim 1 wherein the first film is formed on the surface of said pipe by applying to said surface a suspension of metal oxide fine powder in the presence of hydrofluoric acid, then drying the suspension on said pipe.

5. The method of claim 1 wherein said lubricant film is formed on the surface of said first film on said pipe by applying, as the lubricant material, graphite in a volatile organic solvent or water onto the surface of the first film on the pipe and then drying to remove the organic solvent or water.

6. The method of claim 1 wherein the total thickness of said first and second films is about 5 to 100 microns.

* * * * *